US006308859B1

(12) United States Patent
Johnson

(10) Patent No.: US 6,308,859 B1
(45) Date of Patent: Oct. 30, 2001

(54) COMMUNION CUP

(76) Inventor: Ron D. Johnson, 1851 Gibbs Shoals Rd., Greer, SC (US) 29650

( * ) Notice: Subject to any disclaimer, the term of this patent is extended or adjusted under 35 U.S.C. 154(b) by 0 days.

(21) Appl. No.: 09/532,110

(22) Filed: Mar. 21, 2000

(51) Int. Cl.[7] ..... B65D 25/00
(52) U.S. Cl. ..... 220/756; 220/738; 229/402
(58) Field of Search ..... 220/737, 738, 220/743, 769, 771, 755, 756, 758; 229/402

(56) References Cited

U.S. PATENT DOCUMENTS 952,365 * 3/1910 Sharon ..... 229/402
1,530,256 * 3/1925 Garland ..... 220/738 X
2,796,067 * 6/1957 McCutcheon et al. ..... 229/402 X
3,409,207 * 11/1968 Eicholtz et al. ..... 220/738 X
4,791,030 * 12/1988 DeMars ..... 220/738
5,174,965 * 12/1992 Jones et al. ..... 229/402 X

* cited by examiner

*Primary Examiner*—Steven Pollard
(74) *Attorney, Agent, or Firm*—Dority & Manning, P.A.

(57) ABSTRACT

A communion cup for religious communion services includes a body defining a top rim. A handle member is connected to the body and extends upwards from a plane through the rim. The handle member includes a manual grasping section such that a person can manually lift the communion cup from a serving tray by grasping the handle member at the grasping section.

13 Claims, 2 Drawing Sheets

COMMUNION CUP

BACKGROUND OF THE INVENTION

The present invention relates to a communion cup for religious services.

Relatively small communion cups held in a serving tray are used by various religious denominations in their communion services. These conventional cups are typically cylindrical or truncated and fit into holes in a top surface of the serving tray. A relatively small portion of the cup extends above the tray for manual grasping. This conventional arrangement presents problems for many individuals.

For example, individuals suffering from arthritis or other physical ailments that impair the mobility of the fingers and joints have an extremely difficult time grasping and withdrawing the communion cups from the service tray. Elderly individuals have a particularly difficult time. Even if the communion cups are successfully withdrawn from the tray, it is a relatively difficult task to manipulate the small cup to a drinking position, particularly if the individual's grasp must somehow be changed in the process. The communion service tends to be an unnecessarily anxious moment for many individuals due simply to the conventional communion cup and tray apparatus. The present invention provides an improvement to conventional communion cups.

SUMMARY

It is therefore a principal object of the present invention to provide a communion cup for religious communion services that is relatively easy for an individual to grasp and remove from a service tray and to raise the cup for drinking.

Additional objects and advantages of the invention will be set forth in part in the following description, or may be obvious from the description, or may be learned through practice of the invention.

In accordance with the invention, a communion cup is provided for religious communion services. The cup includes a body that defines a top open rim. The body may take on various configurations, including a truncated body, cylindrical body, etc. The body may include a flange portion at the top thereof that defines the position of the cup within a communal service tray.

A handle member is connected to the body and extends upwards from a plane through the rim. The handle member comprises a manual grasping section such that a person can manually lift the cup from the service tray by grasping the handle at its grasping section. In a preferred embodiment, the handle member also extends laterally from the rim. For example, the handle member may comprise a first vertical section connected to a second horizontal section. The horizontal section is connected to the body, for example at the rim of the body.

It should be appreciated that the communion cup according to the invention is not limited in any way to the material or process by which it is formed. For example, the communion cup may be formed of a single integrally molded plastic component. The communion cup may also be formed from metal, or any other conventional material.

In a preferred embodiment, the handle member may be formed integral with the body of the communion cup so that the two components are defined by a single integral piece.

In an alternative preferred embodiment, the handle member may comprise a component that is separate from the body member. In this embodiment, the handle member is connectable to or engaged with the body and is reusable with other body members. For example, a handle member may comprise a holder in which the body is inserted and seated. For example, the holder may comprise a closed circumferential member, such as a closed loop or circle, into which the body fits. The flange section at the top of the body will define the position of the body within the holder. The holder includes an upstanding vertical section, as well as the grasping section discussed above. The holder may also include a horizontally extending section.

The invention will be described below in greater detail through use of the figures.

DETAILED DESCRIPTION

Figure 1:
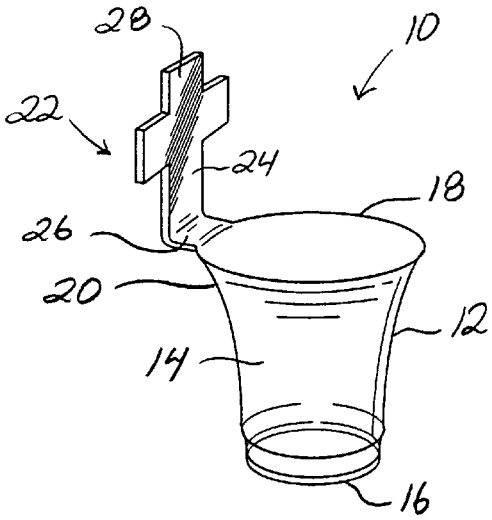
FIG. 1 is a perspective view of an embodiment of a communion cup according to the invention.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations as come within the scope and spirit of the invention.

Figure 4:
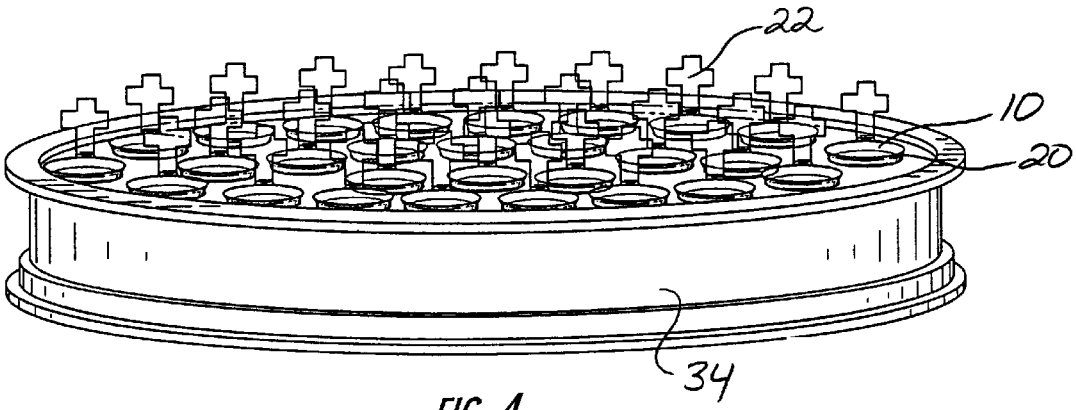
FIG. 4 is a perspective view of a service tray holding communion cups according to the invention.

A communion cup 10 according to the invention is illustrated in the figures. Cup 10 includes a body 12 having a longitudinally extending circumferential side 14, a bottom 16, and an upper rim 18. Body 12 is illustrated in the figures as a generally truncated member having an upper flange portion 20. It should be appreciated, however, that body 12 can have any general configuration, including a cylindrical body, or any conventional communion cup configuration. Generally, conventional communion cups include some sort of flange or radially extending member or section at the top portion so that the cups do not slide completely through the holes or recesses defined in the service tray. For example, FIG. 4 illustrates communion cups 10 according to the invention inserted into a conventional service tray 34. It can be seen that the height of the cups 10 above the top surface of the service tray 34 is defined by the upper flange portion 20 of the cup bodies.

It should also be appreciated that communion cup 10, and particularly body 12, are not limited to any type of material. The cup may be formed from a plastic material according to any conventional forming process. Alternatively, the cup may be formed from glass, crystal, metal, or any other conventional material.

Communion cup 10 according to the invention includes a handle member, generally 22. Handle member 22 has a configuration so as to extend upwards or vertically from a plane through rim 18. Handle member 22 includes a manual grasping section 28 so that a person can manually lift cup 10 from the service tray 34 by simply grasping handle member 22 at the grasping section 28.

Handle member 22 is attached to body member 12 generally near rim 18. In the embodiment shown in FIGS. 1 through 3, handle member 22 extends generally from rim 18. Handle member 22 may include a vertically extending section 24 defining grasping section 28 at the top thereof. Vertical section 24 may merge with a horizontally extending section 26 that is connected to body 12. Horizontal section 26 may be preferred in that it provides greater radial separation between the handles. Thus, referring to FIG. 4, the lateral displacement of handle members 22 resulting from horizontal section 26 provides an increased distance or space between the handle members thereby making it easier for an individual to grasp any one handle member.

Figure 2:
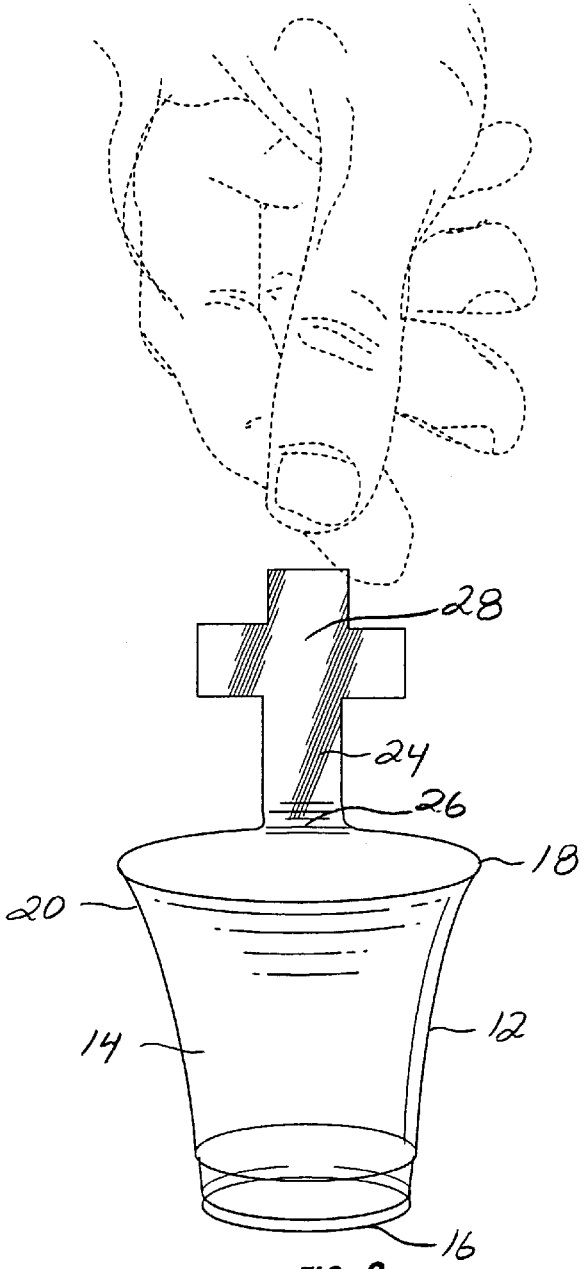
FIG. 2 is a perspective view of the communion cup according to the invention being manually grasped by an individual.
Figure 3:
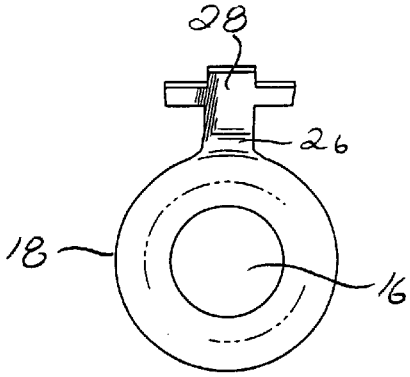
FIG. 3 is a top view of the communion cup illustrated in FIG. 1.

Handle member 22 is illustrated in FIGS. 1 through 3 as an ornamental cross. It should be appreciated that this is not a limitation of the invention and that handle member 22 may take on any ornamental shape or configuration. The same applies for grasping section 28.

Figure 5:
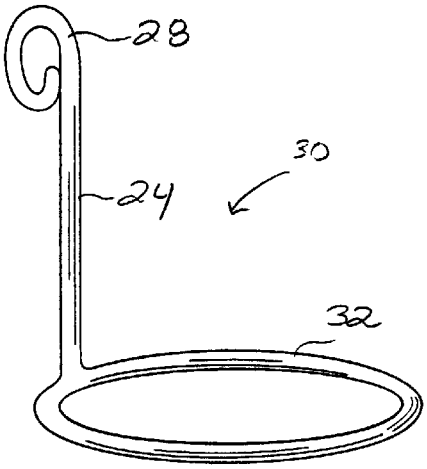
FIG. 5 is a perspective view of an embodiment of the handle member according to the invention.
Figure 6:
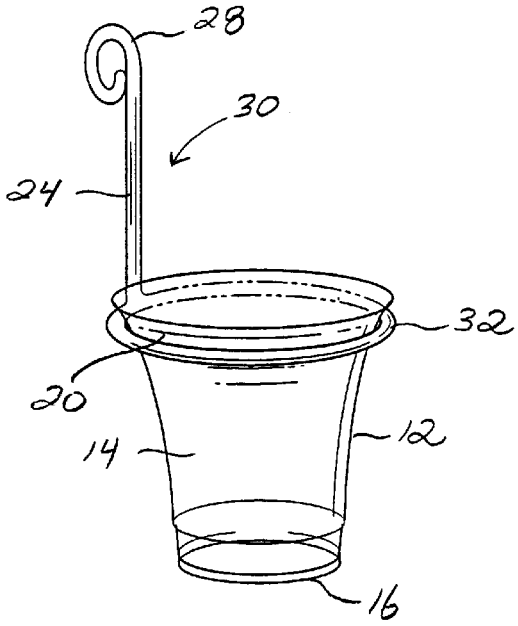
FIG. 6 is a perspective view of the communion cup incorporating the handle member of FIG. 5.

In a preferred embodiment illustrated in FIGS. 5 and 6, the handle member 22 is a separate component from body 12 and comprises a cup holder 30. Cup holder 30 may have a closed or open circumferential member 32 defining an opening through which body 12 of the cup is inserted, as shown in FIG. 6. The flange section 20 of body 12 ensures that the body does not slide completely through the circumferential loop or member 32. Holder 30 also includes a vertical section 24 and a grasping section 28. Although not illustrated in FIGS. 5 and 6, a horizontal section may also be included between vertical section 24 and the circumferential member 32. It should also be understood that the vertical section 24 and grasping section 28 can take on any ornamental configuration.

It should be appreciated by those skilled in the art that various modifications and changes can be made to the embodiments of the invention described herein. It is intended that such modifications and variations be included within the present invention as come within the scope and spirit of the appended claims and their equivalents.

What is claimed is:

1. A communion cup for religious communion services, said cup comprising a body defining a top rim; and a handle member connected to said body and extending upwards from a plane through said rim, said handle member further comprising a manual grasping section such that a person can manually lift said cup from a serving tray by grasping said handle member at said grasping section, wherein the manual grasping section is vertical in orientation and completely above the top rim.

2. The communion cup as in claim 1, wherein said handle member also extends laterally from said rim.

3. The communion cup as in claim 2, wherein said handle member comprises a first vertical section connected to a second horizontal section, said horizontal section connected to said body.

4. The communion cup as in claim 1, wherein said handle member is formed integral with said body.

5. The communion cup as in claim 1, wherein said handle member is connected to said body generally at said rim.

6. The communion cup as in claim 1, wherein said handle member comprises a separate component engaged with said body such that said handle is reusable with other said bodies.

7. The communion cup as in claim 6, wherein said handle member comprises a holder in which said body is seatable.

8. The communion cup as in claim 7, wherein said body comprises a flange portion generally at said rim, and said holder comprises a closed circumferential member, wherein said body fits through said holder and is held in said holder by said flange portion.

9. The communion cup as in claim 1, wherein said body and said handle member are molded as a single piece.

10. A communion cup for religious communion services, said cup comprising a body defining a top rim; and a handle member connected to said body and extending upwards from a plane through said rim and extending laterally from said rim, said handle member further comprising a manual grasping section such that a person can manually lift said cup from a serving tray by grasping said handle at said grasping section, wherein the manual grasping section is vertical in orientation and completely above the top rim.

11. The communion cup as in claim 10, wherein said handle member comprises a first vertical section connected to a second horizontal section, said horizontal section connected to said body.

12. The communion cup as in claim 10, wherein said handle member is formed integral with said body.

13. The communion cup as in claim 10, wherein said handle member is a separate component removable from said body.

* * * * *